US006059145A

United States Patent [19]

Stratton et al.

[11] Patent Number: 6,059,145

[45] Date of Patent: May 9, 2000

[54] BEVERAGE DISPENSER

[75] Inventors: Gus J. Stratton, Chino Hills, Calif.; Peter K. Stratton, Dearborn, Mich.

[73] Assignee: Juicy Whip, Inc., Irwindale, Calif.

[21] Appl. No.: 09/106,886

[22] Filed: Jun. 30, 1998

Related U.S. Application Data

[62] Division of application No. 08/481,981, Jun. 7, 1995, and a continuation of application No. 08/406,819, Mar. 20, 1995, abandoned, and a continuation of application No. 08/178,473, Jan. 5, 1994, abandoned, and a continuation of application No. 07/707,987, May 22, 1991, abandoned, and a continuation of application No. 07/402,198, Sep. 1, 1989, abandoned.

[51] Int. Cl.[7] ..... B67D 13/00; B67D 5/56; B65D 5/66; G09F 19/00

[52] U.S. Cl. ..... 222/78; 222/113; 222/129.1; 40/406

[58] Field of Search ..... 222/1, 113, 129.1, 222/60, 129.4, 78, 146.6; 40/406, 407

[56] References Cited

U.S. PATENT DOCUMENTS

| | | | |
|---|---|---|---|
| 1,124,905 | 1/1915 | Huber . | |
| 1,487,816 | 3/1924 | Sintzel . | |
| 1,654,379 | 12/1927 | Matzka . | |
| 1,669,444 | 5/1928 | Borchert | 40/406 |
| 1,760,887 | 6/1930 | Saugman | 40/406 |
| 1,762,126 | 6/1930 | Smith | 40/406 |
| 1,782,685 | 11/1930 | Glaze et al. . | |
| 1,782,943 | 11/1930 | Stanford et al. . | |
| 1,782,944 | 11/1930 | Stanford et al. . | |
| 2,072,841 | 3/1937 | Tracey et al. . | |
| 2,203,054 | 6/1940 | Holmes et al. . | |
| 2,741,400 | 4/1956 | Hazzard . | |
| 3,206,069 | 9/1965 | Jacobs et al. . | |
| 3,503,541 | 3/1970 | Jacobs et al. . | |
| 3,531,635 | 9/1970 | Hancock | 40/106.2 |
| 3,892,335 | 7/1975 | Schroeder | 222/129.1 |
| 4,160,512 | 7/1979 | Cleland | 222/56 |
| 4,366,920 | 1/1983 | Greenfield, Jr. et al. | 222/145 |
| 4,419,283 | 12/1983 | Schneider | 252/600 |
| 4,538,636 | 9/1985 | Cleland | 137/216 |
| 4,544,084 | 10/1985 | Cleland | 222/56 |
| 4,631,210 | 12/1986 | McGee et al. | 428/13 |
| 4,676,401 | 6/1987 | Fox et al. | 222/1 |
| 4,686,784 | 8/1987 | Smithies | 40/406 |
| 4,728,005 | 3/1988 | Jacobs et al. | 222/64 |
| 4,856,676 | 8/1989 | Emody | 222/66 |
| 4,955,507 | 9/1990 | Kirschner et al. | 222/65 |
| 5,258,209 | 11/1993 | Bankert et al. | 428/11 |
| 5,537,838 | 7/1996 | Mills et al. | 222/146.6 X |
| 5,575,405 | 11/1996 | Stratton et al. | 222/1 |
| 5,715,700 | 2/1998 | Credle, Jr. | 222/129.1 X |
| 5,909,826 | 6/1999 | Credle, Jr. | 222/78 |

OTHER PUBLICATIONS

Alonzo, Ron, "The Question Heard Round The World: Post Mix Or Visual?", Jet Spray World Beverage News, Spring 1989.

"There's Nothing Sticky Abouth The Automix. Not Even The Price", Cleland Sales Corporation.

Quality Bevereage Dispenser, Starline, Sep. 1980.

"Starline Stwo AFS Beverage Dispenser", The Cornelius Company, 1989.

"Visual Display Dispenser, Two–Flavor Automatic Filing For Non–Carbonated Beverages", Jet Spray.

*Primary Examiner*—Kevin Shaver
*Assistant Examiner*—David A. Bonderer
*Attorney, Agent, or Firm*—Rader, Fishman & Grauer PLLC

[57] ABSTRACT

A post-mix beverage dispenser of the type that dispenses beverage components in predetermined proportions on demand from a dispensing outlet is provided to dispense the actual beverage, and a visible display simulating a transparent display container having the beverage therein and comprising materials resistant to organic growth is arranged with respect to the dispensing outlet to effect the appearance that the display is the source of the dispensed beverage.

4 Claims, 4 Drawing Sheets

BEVERAGE DISPENSER

This application is a Divisional of application Ser. No. 08/481,981, filed Jun. 7, 1995, the contents of which are incorporated herein by reference, which is a Continuation-in-Part of Ser. No . 08/406,819, filed Mar. 20 1995 now abandoned; which is a File Wrapper Continuation of Ser. No. 08/178,473, filed Jan. 5, 1994, now abandoned; which is a File Wrapper Continuation of Ser. No. 07/707,987, filed May 22, 1991, now abandoned; which is a File Wrapper Continuation of Ser. No. 07/402,198, filed Sep. 1, 1989 now abandoned.

1. FIELD OF THE INVENTION

This invention relates in general to improvements in fountain-type beverage dispensers and in particular to the simulation of transparent beverage display tanks or bowls for use with post-mix type beverage dispensers.

2. THE PRIOR ART

For years, two basic types of fountain dispensers have been available to the trade, referred to respectively as "pre-mix" and "post-mix" dispensers.

Pre-mix dispensers mix a syrup concentrate and a diluent, usually water, to provide a finished premixed beverage which is then stored in a holding tank until dispensed through a pre-mix faucet located on the dispenser. The holding tank may be opaque, or transparent for display purposes, and is usually referred to as a "bowl".

Post-mix dispensers do not pre-mix and store the syrup and water. Instead, immediately prior to being dispensed, the syrup and diluent are conveyed by separate conduits to proportioning valves in a valve housing and then dispensed in predetermined proportions through the usual post-mix faucet or outlet on the valve housing. The syrup may be stored remotely from the valve housing in a metallic cylinder, or in a collapsible plastic bag in a cardboard box known to the trade as "bagin-box". The water source may be the available municipal water line.

The typical pre-mix dispenser having a transparent display bowl or holding tank obtains the advantages of a visual beverage display that is a powerful merchandising tool for stimulating impulse buying. On the other hand, the display bowl containing a premixed beverage requires frequent cleaning to remove bacterial induced organic growth. Because, of the limited size of the display bowl, the pre-mix dispenser also has small dispensing capacity that requires frequent manual filling, or the added expense and complexity of automatic filling.

The typical post-mix dispenser available heretofore had no transparent display bowl or holding tank and of course no bowl cleaning problem. It had large dispensing capacity and automatic mixing, but provided no visual display of the beverage and consequently lost a powerful merchandising tool.

The invention described in said co-pending application Ser. No. 08/406,819, combines selected portions of the post-mix and pre-mix beverage dispensers in a unique manner to obtain the principal advantages and avoid the principal disadvantages of each. In brief, that invention dispenses beverage components in predetermined proportions on demand from a post-mix dispensing outlet to provide a potable beverage for immediate consumption. A transparent display bowl containing a display fluid that is never dispensed for consumption, but that appears to be a supply of the potable beverage immediately available to be dispensed, is arranged with respect to the post-mix dispensing outlet to effect the appearance to consumers that the transparent display bowl is the principal source of the potable beverage dispensed from the post-mix dispensing outlet.

The cleaning problem was recognized but not solved satisfactorily in the 1930 Saugman U.S. Pat. No. 1,760,887, which stated the mind set of the art that has existed until the public disclosure of the invention described in said co-pending application.

> "It is, of course, desirable . . . that the beverage itself be displayed . . . However, . . . most display devices of this type have been . . . very difficult to clean and, therefore, in practice, they are often neglected and allowed to become dirty and unattractive".

Saugman's solution was merely to provide parts which "are of simple construction and are accessible so that they can be easily and thoroughly cleaned".

A specific narration of the cleaning problems associated with pre-mix display bowls is also set out in the Fox et al. U.S. Pat. No. 4,676,401, which states in order to emphasize the advantages of their post-mix dispenser:

> "Typically these beverages are made from a combination of a concentrate and a diluent, usually water. The concentrate by itself generally does not require refrigeration and has a shelf life of several months to over a year. However, when mixed with a diluent such as water or exposed to air, the combined beverage usually requires refrigeration to retard bacterial growth . . .
>
> "Pre-mixed dispensers suffer from a number of disadvantages. Even with refrigeration, some bacterial growth is present. Consequently, after a period of time, typically a few days, any remaining pre-mixed beverage should be discarded to maintain healthy quality and a pleasing beverage taste."

Fox et al solved the cleanliness problems associated with a beverage display bowl in the same way all post-mix dispensers did, i.e., by eliminating the display bowl—and of course all the desirable features of visual display.

The pre-mix dispenser also has the disadvantage of a low volume dispensing capacity for the display bowl, which usually contains about three gallons of pre-mixed beverage in a 5:1 water:syrup ratio. Accordingly, fresh batches of syrup and water must be carefully mixed, often while customers are waiting, then poured into the open top of the container. Alternately, the water and syrup are poured into the bowl separately and then manually stirred. When this is done, care must be taken to pour the water in before the syrup, otherwise jamming of the agitating device can occur. These procedures are customarily carried out by hand.

Inasmuch as the concentrated syrup requires large volumes of water in a predetermined ratio, careful proportioning is required to provide a suitable drink. Such careful proportioning is not always achieved, rendering the drink too weak or too strong. Also, in order to fill the display bowl, the waitress or person in charge of dispensing must raise the water and syrup above the display bowl on the counter and pour the liquid into the open top. Spilling may result and additional labor is required to clean a sticky mess. After the display bowl is refilled, time is frequently required to cool the freshly mixed beverage—with customers waiting.

Post-mix dispensers avoid the problems associated with cleaning the display bowl and its parts because there is no display bowl. Sanitation has not been a problem because for all practical purposes, syrups are not biologically active in their concentrated form. Bacterial growth accelerates and becomes problematic only after the syrup has been diluted with water for several days. Inasmuch as the syrup and water are not mixed in post-mix dispensers until the beverage is ready to be consumed, it follows that bacterial growth is not a problem. Post-mix dispensers do not have a low volume dispensing capacity problem because the large syrup capacity of the bag-inbox or storage cylinders and the mixing of the syrup and water at the time the drink is dispensed provide a vastly greater dispensing capacity than possible with pre-mix dispensers. When the bag-in-box or cylindrical containers are empty, they are readily replaced by full containers.

Manual refilling is not a problem with post-mix dispensers, again, because there is no display bowl to refill and the syrup and water are mixed automatically in proper proportions. Thus the post-mix dispensers indeed avoid the problems of cleaning, filling and low dispensing capacity, but do so by eliminating the display tank which is universally regarded as a most important inducement to increased sales and beverage consumption. In particular, it is well known by the trade that colored drinks such as orange, punch, and even lemonade simply do not sell well unless they are visually displayed in a transparent bowl.

Prior to said co-pending application, the art had made various attempts to combine some of the advantages of the post-mix dispenser with the customary display container. As taught by U.S. Pat. Nos. 4,160,512; 4,538,636; and 4,544,084 to Cleland and U.S. Pat. No. 4,728,005 to Jacobs et al, an automatic or self-fill system uses a post-mix dispenser to supply water and syrup concentrate from concealed sources in metered quantities to an otherwise conventional pre-mix display container when the beverage level falls to a predetermined level. The self-fill system avoided the problems associated with frequent hand mixing and refilling of the display container, but introduced its own set of problems, including complex plumbing and additional cost for the dispenser, and it did not solve the more important problem of maintaining a clean and inviting beverage display.

The problems associated with automatic mixing devices for beverage dispensers and cleaning the same are highlighted by literature published by the Cleland Sales Corp., which has been particularly active in attempts to provide a superior transparent-bowl type beverage dispenser. Regardless of Cleland's efforts, the problem of maintaining a clean transparent display bowl for a pre-mix beverage dispenser were not solved, although such problems were clearly recognized by the Cleland literature.

Cleland provided an auto-mix unit for mixing water and concentrate that replaced the removable lid for the conventional beverage display container. Cleland's advertising literature not only includes several pages of maintenance and cleaning instructions, but points out the problems of manual mixing and filling associated with pre-mix type display bowls.

> "Up until now, keeping your beverage dispenser full has been a little sticky. There's been the problem of stop-over. The step-ladder balancing acts. And maintaining the kind of beverage consistency and quality that guarantees repeat sales. But most important, there have been those lunch time crunches when you've ended up having to refill your beverage dispenser. Busy times when your labor could have been used somewhere else . . . . The auto-mix unit is designed to automatically mix beverage syrup with the proper amount of water and provide a constant level of beverage in the dispenser bowl."

Automatic refilling devices have not been widely successful. They require complicated mechanical and electrical means, and thus as noted above, bring along a host of new problems including increased cost, diminished aesthetics, and the exacerbation of the cleaning problems because the automatic filling devices have components that also require cleaning and maintenance. Although the filling and low dispensing capacity problems have been solved in a fashion, the most serious problem, cleaning, has not been solved.

In short, regardless of the recognition of the above-mentioned problems with pre-mix and post-mix dispensers and the incentives for eliminating such problems, there has been no previous insight to provide the necessary structures for simply and effectively solving these problems. A patent to Hazzard U.S. Pat. No. 2,741,400 discloses a transparent sealed display container 48 mounted above a dispensing unit 12 containing a refrigerated container 18 for a premixed beverage. The patent does not consider the possibility of avoiding cleaning of the tank 18 and the display container 48, nor other problems associated with pre-mix beverage containers, such as frequent refilling and accurate proportioning of the beverage components for the refill. Although the tank 18 is concealed from view, it still must be cleaned periodically to eliminate mold and bacterial growth that otherwise would render the beverage unfit for consumption.

3. OBJECTS OF THE INVENTION

Important objects of the present invention are to provide an improved display and beverage dispensing apparatus generally of the type disclosed in said co-pending application, but wherein the display is modified to comprise a simulation of a display container having a supply of premixed beverage stored therein and immediately available to be dispensed from the post-mix dispensing outlet for immediate consumption.

In one such modification, the premixed beverage itself may be an illusion.

In another such modification, a display fluid simulating the premixed beverage may be the beverage concentrate that is dispensed with the diluent in predetermined proportions from the post-mix dispensing outlet to provide the potable beverage. As noted above in the quotation from the Fox et al patent, such concentrates have a shelf life of many months or a year or more until diluted with water, enabling use of a readily available and long overlooked source of a sales promoting display fluid.

Other objects are to provide an improved construction and arrangement of parts in such a display that reduce the quantity of display fluid required to fill the display container; and to provide such a dispenser that provides simple and improved means for mixing water and concentrate, even thick concentrates that are otherwise difficult to mix without a mechanical agitator.

4. SUMMARY OF THE INVENTION

The present invention preserves the most desirable features of both the pre-mix and post-mix beverage dispensers by providing a post-mix beverage dispenser of the type that is operable to receive separate beverage components, such as a diluent, usually but not necessarily water, and a syrup concentrate and to dispense said components in predetermined proportions through a post-mix dispensing outlet or faucet to produce a potable beverage, in combination with a simulation of a transparent display container or bowl visibly displaying a premixed beverage immediately available for consumption. The simulation is arranged with respect to the post-mix dispensing outlet to create the visual impression that the simulation is the principal source of the beverage dispensed from the dispensing outlet.

The simulation may be an optical illusion, or may be a display bowl containing a fluid such as a beverage concentrate that has the appearance of the dispensed beverage and is essentially sterile or resistant to organic growth. The beverage concentrate within the display bowl is in fluid communication with the post-mix dispenser which dispenses the concentrate with a diluent in predetermined proportions from the post-mix dispensing outlet to provide a potable beverage on demand for immediate consumption. As rapidly as the concentrate is dispensed from the display bowl, it is replaced from a conventional supply of concentrate, which may be a bag-inbox supply.

The advantages of the present invention will appear in the following description and appended claims, reference being had to the accompanying drawings forming a part of this specification wherein like reference characters designate corresponding parts in the several views.

5. BRIEF DESCRIPTION OF THE DRAWINGS

Figure 1:
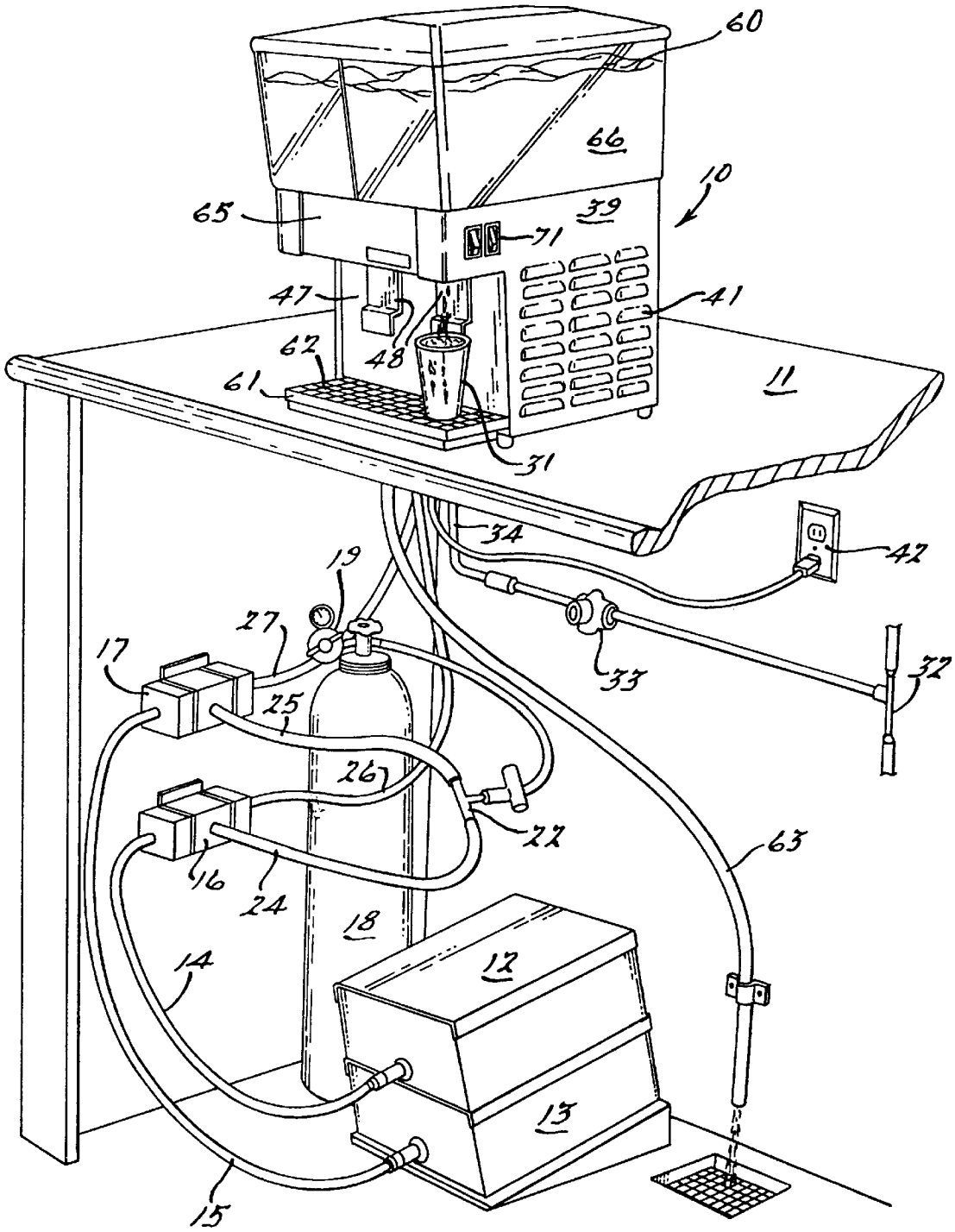
FIG. 1 is a diagrammatic perspective view of a beverage dispenser embodying the present invention, showing the countertop display bowl with its auxiliary equipment located below the counter and concealed from public view.
Figure 2:
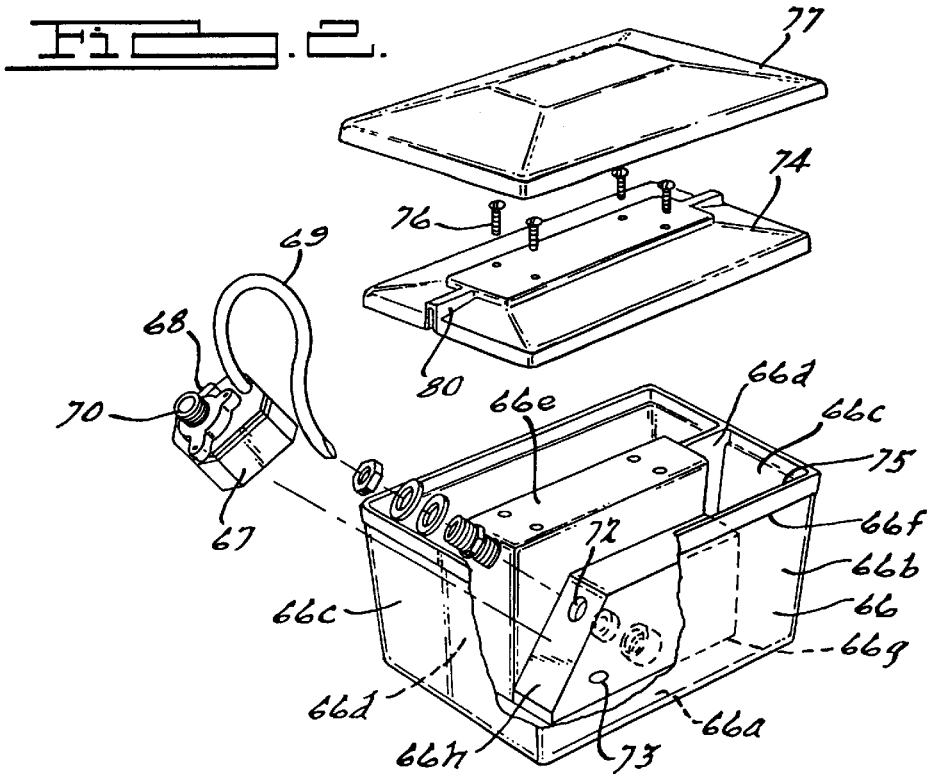
FIG. 2 is an exploded perspective view of the transparent display bowl illustrated in FIG. 1.

It is understood that the invention is not limited in its application to the details of construction and arrangement of parts illustrated in the accompanying drawings, since the invention is capable of other embodiments and of being practiced or carried out in various ways, and that the phraseology or terminology employed herein is for the purpose of describing the invention claimed in the appended claims.

6. DESCRIPTION OF PREFERRED EMBODIMENTS

Referring to the drawings, a post-mix beverage dispenser embodying the present invention includes a housing 10 for a cooling unit supported by way of example on a counter 11 of a food serving establishment. Below the counter 11 and preferably concealed from public view is auxiliary equipment comprising sources 12 and 13 for two different beverage concentrates, such as orange and lemon, for mixing with a diluent that may be water to provide a fruit type beverage, or the diluent may be carbonated to provide a carbonated beverage as is commonly dispensed from post-mix dispensers.

The sources 12 and 13 may each comprise what is known to the trade as a bag-in-box source of concentrate comprising a replaceable collapsible plastic bag filled with the concentrate and contained within a cardboard box. The collapsible bags within the boxes 12 and 13 are connected by separate conduits 14 and 15 to separate pumps 16 and 17 suitably powered, as for example by electricity or gas pressure. In the present instance, compressed carbon dioxide stored in a tank 18 equipped with a pressure regulator 19 supplies regulated gas pressure via conduit 21 to a juncture 22 and thence by separate conduits 24 and 25 to power the pumps 16 and 17 respectively. The latter may be conventional and pump the associated concentrates via conduits 26 and 27 to separate valve housing or mixing blocks 28 and 29, wherein the concentrates are mixed with water on demand and dispensed in a customary manner as described below into a container or cup 31. The spent carbon dioxide gas is exhausted from the pumps 16 and 17 to atmosphere without coming into contact with the concentrate.

Figure 6:
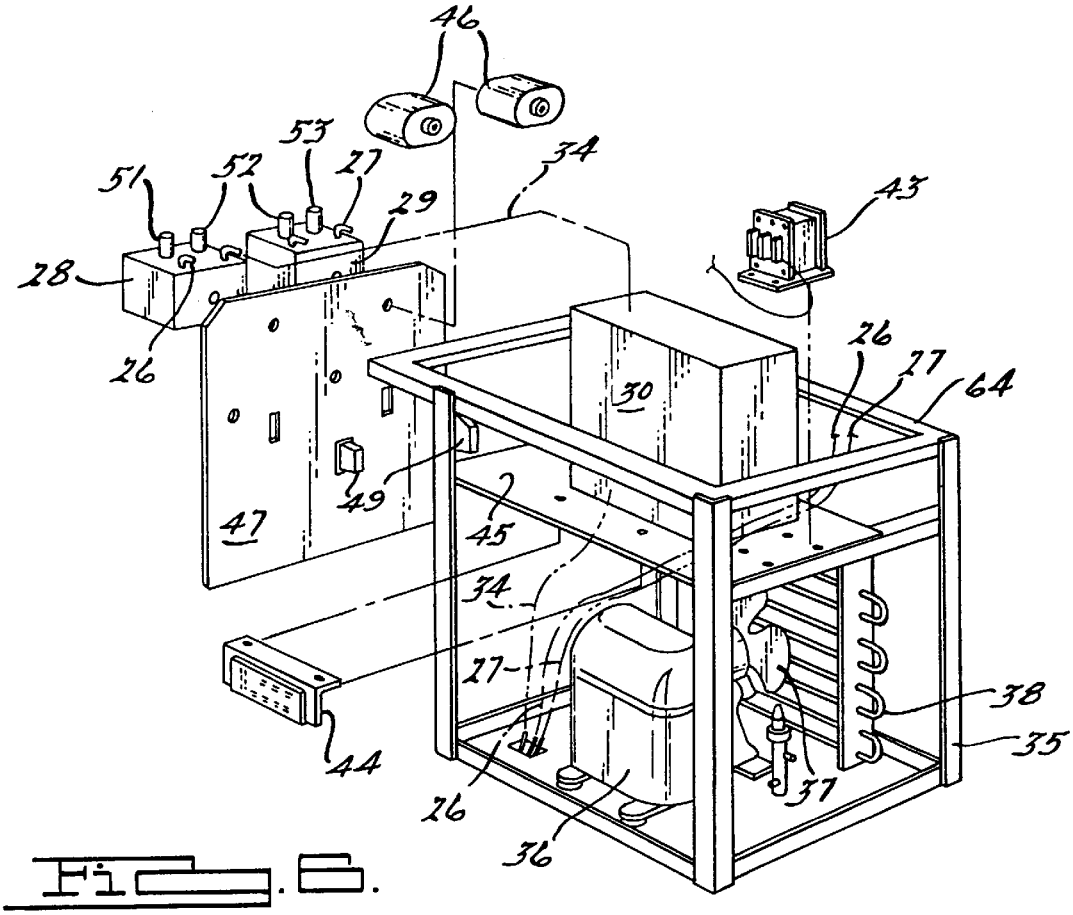
FIG. 6 is an exploded perspective view of the supporting frame for the display bowl, illustrating the arrangement of important operating parts for the dispenser.

The water for mixing may be obtained from the available public water supply 32 and is conducted via pressure regulator 33 and water line 34 to the valve or mixing blocks 28 and 29. Prior to entering the mixing blocks 28, 29, the water conduit 34 preferably passes through an insulated refrigerator tower 30, FIG. 6, cooled conventionally by a refrigeration assembly including a compressor 36 and fan 37. The latter dissipates heat from condenser coils 38 that conventionally connect compressor 36 and cooling coils within refrigerator tower 30. After cooling the tower 30, the refrigerant is returned conventionally to the compressor 36 to complete the refrigeration cycle. The compressor 36 and fan 37 are electrically powered and the entire refrigeration assembly is enclosed within a housing frame 35 supporting exterior trim panels 39, FIG. 1, some of which may be louvered as at 41 to facilitate escape of beat from the condenser 38.

The refrigerating assembly may also be conventional and operates to chill the water in line 34 as it passes through coils in tower 30 on its way to the blocks 28 and 29. Preferably the refrigeration assembly is thermostatically controlled to prevent overchilling and to maintain a reasonably constant cold temperature for the water passing therethrough. The concentrate is usually too thick to be refrigerated. It is thus pumped directly from pumps 16 and 17 to the blocks 28 and 29, respectively.

The refrigeration assembly may be omitted in some instances where the beverage is served with cracked ice in the cup 31.

Suitable electric power 42, which may be 110 V.A.C., may be supplied directly to the motors for the compressor and fan and in parallel to a transformer 43 and thence to a terminal strip 44 by electric leads not shown. The refrigerator tower 30, transformer 43, and strip 44 may be supported by a platform 45 mounted in the frame 35 above the compressor 36 and extending only partly across the width of the frame 35 to provide a passage for the conduits 26, 27 to the blocks 28, 29, and for the conduit 34 and refrigerant from coils 38 to the refrigerator tower 30. The blocks 28, 29 and associated motors 46 for the beverage whipping means, where whipping is desired, may be supported by a vertical front panel 47 secured to the forward end of the frame 35.

When beverage dispensing is desired, the cup 31 is pressed rearwardly against one of the push levers 48 pivotally mounted on the exterior surface of the panel 47.

Each lever 48 is associated with one of the beverages to be dispensed and actuates an associated switch 49 which in turn actuates an associated set of solenoid operated proportioning valves 51, 52 or 53 in the appropriate block 28 or 29 to open ports in their water and concentrate lines 34, 26 or 34, 27 and admit the flow of water and concentrate in predetermined proportions into the cylindrical mixing chamber 54 of the appropriate block 28 or 29. The water and concentrate are supplied under predetermined pressures determined by the water regulator 33 and the associated pump 16 or 17 to assure discharging of the water and concentrate in proper proportions into the chamber 54, from which the mixed beverage is dispensed through outlet 56 and funnel 57 opening from the lower forward portion of the chamber 54.

If whipping of the mixture is desired, actuation of the switch 49 also activates the appropriate motor 46 to rotate the motor driven shaft 58 and the coaxially connected whipper blade 59. Each shaft 58 extends coaxially into its chamber 54 and through suitable seals in the rear end wall of the associated block 28 or 29 to prevent leakage of beverage from the chamber 54. A drip tray 61 containing a grid 62 is provided to underlie the cup 31 and enable passage of beverage overflow via drain line 63 to a drain, FIG. 1.

The structure described thus far and its operation may be conventional for post-mix dispensers and are accordingly not considered in further detail.

The frame 35 provides a rectangular top 64 cantilevered forwardly to overlie the blocks 28, 29 whereby they are conveniently concealed by a forward outer trim panel 65, FIG. 1. Also supported on the frame top 64 is a sealed transparent display bowl 66 having a bottom 66*a* overlying the frame portion 64 and overlapping the same for appearance. Lateral plates 66*b* and fore and aft plates 66*c* diverge upwardly from the bottom 66*a*, again for appearance. An upright longitudinal divider partitions the bowl 66 into two lateral portions for receiving two separate fluids and includes vertical end portions 66*d* and a centrally located spacer 66*e* having a flat top flush with the tops of the divider parts 66*d* and upper edges of the plates 66*b* and 66*c*. The front, rear, and lateral sides of the spacer 66*e* extend vertically from the bottom 66*a* and are secured and sealed thereto to reduce the amount of fluid required to fill the bowl 66. The upper edges of the plates 66*b* and 66*c* are reinforced by a double thickness reinforcement 66*f* of the bowl material, which may be a clear hardened plastic.

Also within each lateral partition of the bowl 66 is a second spacer 66*g* having a flat top parallel to the top of spacer 66*e* but of reduced height so as to be concealed when the bowl 66 contains the desired amount of fluid. The mesial side of the spacer 66*g* may open into the adjacent lateral side of the hollow spacer 66e and is sealed around its periphery to the adjacent lateral side wall of spacer 66*e*. The lateral and rear side walls of the spacer 66*g* are preferably vertical and extend to the bottom 66*a* to which they are also secured and sealed. The forward end 66*h* of spacer 66*g* inclines rearwardly at approximately a 45° angle to provide a supporting platform on which a conventional fluid jet mechanism 67 is mounted.

Each lateral spacer 66*g* is preferably hollow and sealed to prevent entry of fluid from the interior of bowl 66, but contains electrical power line 69 for the pump motor within the mechanism 67 that forces a jet of fluid through nozzle 68 substantially in parallelism with the inclined platform 66*h*, thereby to agitate the fluid 60 within the bowl 66, FIG. 1, and simulate the appearance of an inflow of fresh beverage. The fluid discharged from nozzle 68 is replaced within the mechanism 67 via an inlet 70, whereby the fluid within bowl 66 is recirculated through the jet mechanism 67 continuously, at the option of the operator, by operation of one of two electrical switches 71 to power the pump within the mechanism 67. Each of the switches 49 is operative to actuate one of the solenoid sets 51, 52 or 52, 53 when the other switch 71 is closed.

The two spacers 66*g* at opposite sides of the spacer 66*e* and their jet mechanisms 67 may be mirror images of each other. The electrical lead 69 for each jet mechanism 67 extends through a sealed opening at 72 in the associated inclined support 66*h* and thence through a second sealed opening at 73 through the bottom 66*a* and is suitably connected to the transformer 43 via terminal strip 44.

The hollow sealed spacers 66*e*, 66*g* not only occupy appreciable space within the bowl 66 and reduce the quantity of fluid 60 required to fill the bowl 66 to any desired level, they also provide space for the upper end of the refrigerator tower 30, enabling use of a larger tower 30 and more rapid cooling of the water conduit 34 coiled therein than otherwise possible without increasing the overall size of the housing 10. Additionally, the level of fluid 60 within bowl 66 also conceals the spacer 66*g* and agitator 67.

The open top of the display bowl 66 is sealed closed by a removable cover 74 that seals against a peripheral seal 75 overlying the double thickness top 66*f*. Opposite ends of cover 74 provide raised projections 80 having downwardly opening locating grooves for snugly receiving the upper edges of the vertical dividers 66*d* to locate the cover 74 accurately with respect to the spacer 66*e*. Bolts 76 screw into the top of spacer 66*e* to clamp the top 74 tightly in sealed relationship against the seal 75. An ornamental cover 77 removably overlies the sealed cover 74. Replacement of the fluid 60 in bowl 66, or a change in the type of fluid 60 to simulate a different beverage, may be readily accomplished by removing the covers 74 and 77. Although any suitable stable fluid 60 having the appearance of the beverage being dispensed may be used, an alcohol formulated to simulate the color and appearance of the beverage as described in said co-pending application is preferred.

The foregoing discloses the unique combination of a post-mix beverage dispenser 10, a sealed transparent display bowl 66, and a stable sterile fluid 60 within the bowl formulated to simulate the color and appearance of the beverage to be dispensed, whereby the advantages of both the post-mix and pre-mix dispenser are obtained and their attendant disadvantages are avoided. At the outset, the universally recognized requirement of visual display essential for stimulating optimum consumption of a fruit juice type beverage is obtained without the above-noted problems of mold and bacterial growth associated with pre-mix display bowls: i.e., frequent discarding of spoiled beverage and cleaning of the display bowl and its auxiliary equipment, reassembly and occasional breakage of such equipment during the cleaning, mixing fresh concentrate and water to replace the spoiled beverage, pouring the mixture into the bowl with occasional spillage by careless or unskilled employees, necessitating a sticky cleanup, and an inferior beverage resulting from improper proportioning of the fresh concentrate and water. In addition, the post-mix character of the present invention enables a long-lasting supply of concentrate that is automatically mixed with water in proper proportions on demand for immediate consumption, whereby the problems associated heretofore with auxiliary equipment for refilling premixed display bowls are also eliminated.

In regard to the concept of the combination of the post-mix type beverage dispenser and the sealed display bowl, the separate beverage components, i.e., the water and concentrate, may be mixed entirely within a mixing-whipping chamber as disclosed in the Fox et al U.S. Pat. No. 4,676,401, or may be mixed either partially or entirely in the supply conduits to a mixing-whipping chamber as disclosed in the Harrison U.S. Pat. No. 4,747,692, or may if desired by dispensed in the desired proportions without being mixed until entry into the cup 31, for example.

Figure 4:
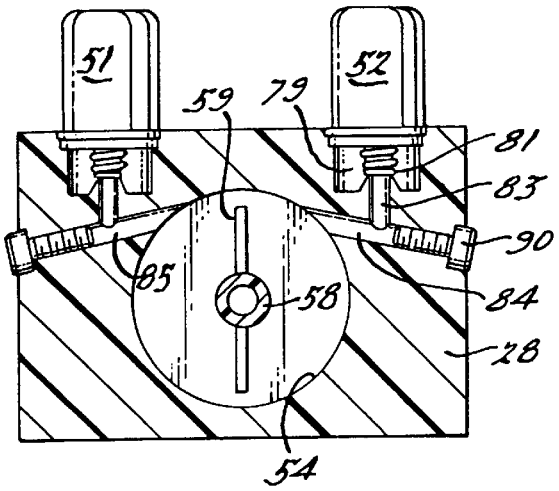
FIG. 4 is a sectional view transverse to the rotational axis of the whipper blade, taken in the direction of the arrows essentially along the line 4—4 of FIG. 3.
Figure 5:
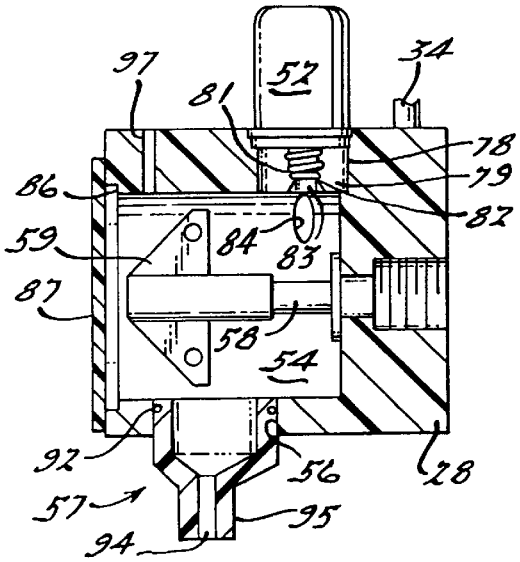
FIG. 5 is a vertical sectional view along the rotational axis of the whipper blade, taken in the direction of the arrows essentially along the line 5—5 of FIG. 3.

An improved and preferred mixing-whipping chamber however is illustrated in FIGS. 4 and 5. The two valve and mixing blocks 28 and 29 are the same in structure and operation, except that block 28 mixes water with the concentrate from source 12 and block 29 mixes water with the concentrate from source 13. Accordingly, only block 28 is illustrated in FIGS. 4 and 5. The water conduit 34 from the refrigerator unit 30 and the concentrate conduit 26 from pump 16 communicate with similarly arranged passages in the block 28, which in fact may be mirror images of each other. Thus only the water passage is illustrated schematically in FIG. 5.

The water conduit 34 is connected via passage 78 in the block 28 with an opening 79 containing a valve plunger 81 operated by solenoid 52. The opening 79 communicates via port 82 with a dogleg passage 83 that opens into an inclined duct 84, FIG. 4. The comparable inclined mirror image duct 85 for the concentrate is similarly connected to its concentrate duct 26. The ducts 84 and 85 are formed by bores that incline inwardly through opposing sidewalls of the block 28 at approximately 60° to its longitudinal axial midplane and enter the cylindrical wall of the mixing chamber 54 at locations such that the pressurized fluid concentrate and water impinge adjacent to the upper surfaces of the chamber 54 at said longitudinal midplane. The pressure of the water and its flow velocity into the chamber 54 is usually greater than that of the concentrate. The water thus overpowers and reverses the direction of the concentrate flow to effect a superior mixing in a spiral flow of the water and concentrate around the cylindrical wall of the chamber 54 and downstream toward the chamber outlet 56. The spiral flow of the mixed water and concentrate hugs and usually completes about four spirals around the cylindrical wall of the mixing chamber 54 before the mixed beverage reaches the whipping blade 59, or outlet 56 if there is no blade 59. The exterior openings for the bores that form passages 84 and 85 are sealed by screw plugs 90. Similarly, horizontal bores through the front faces of the blocks 28, 29 and extending rearwardly to provide part of the conduits 83 and are also sealed by screw plugs 90 at their forward ends. The front end of the cylindrical mixing chamber 54 is sealed closed by an O-ring seal 86 and an endplate 87 clamped by screws 88 to the front end of block 28.

Some beverages such as a comparatively thick drink known as Rica Horchata, thickened with rice flour and cinnamon and favored by many people in the southwest, are preferably not whipped. Such thick beverages have been difficult to mix heretofore without mechanical agitation. The structure described enables satisfactory mixing of the Rica Horchata beverage without use of the whipper blade 59. Thus the latter is not necessary and its expense and that of motor 46 may be eliminated when only such beverages are to be dispensed.

Figure 3:
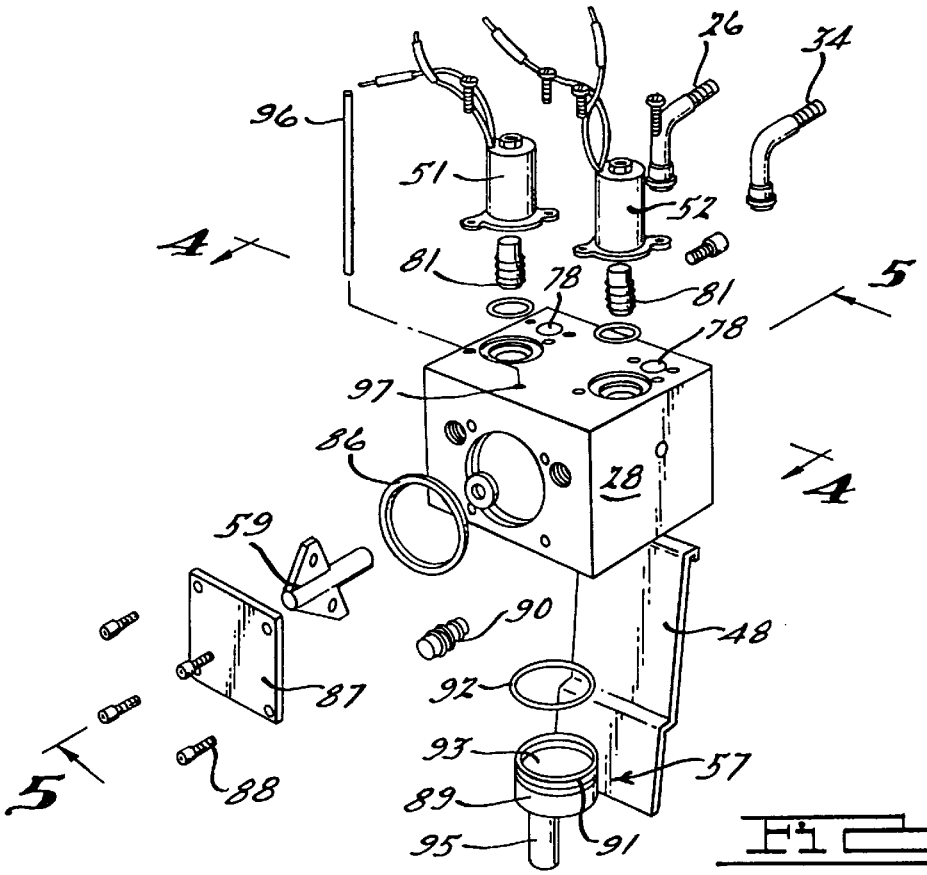
FIG. 3 is an exploded perspective view of one of the valve block or housing assemblies.

Referring back to FIGS. 3 and 5, the outlet 56 comprises a cylindrical hole centered on the longitudinal midplane of the chamber 54 directly below the blade 59 and has a diameter approximately equal to the axial length of the blade 59. The funnel 57 has an upper cylindrical collar 89 dimensioned to fit snugly and slidably within the outlet 56. An annular outwardly opening groove 91 adjacent to the upper end of collar 89 receives an O-ring seal 92 that effects a seal between the exterior of the collar 89 and the interior of the outlet 56 and also frictionally secures the funnel 57 in rotatably adjusted positions. The base 93 of the collar 89 extends at a slight downward angle to facilitate drainage from the funnel 57 and is provided with a bore 94 offset from the vertical axis of the collar 89. The bore 94 opens coaxially into an integral depending tubular spout 95 for directing the dispensed beverage into the cup 31. By rotating the funnel 57 about the axis of the collar 89, limited adjustment of the offset axis of the spout 95 with respect to the center of the cup 31 is enabled. Also the offset location of the bore 94 in the base 93 effects an offset and increased turbulence in the beverage flow from the chamber 54, thereby to inhibit splashing as the beverage enters the cup 31. An air inlet tube 96 frictionally secured within an opening 97 in the wall of the block 28 extends from the atmosphere into the chamber 54 to prevent formation of a vacuum therein and to provide air for the whipped beverage.

It is believed that operation of the beverage dispenser is apparent from the foregoing. Initially, separate formulations of the fluid 60 are poured into the separate compartments at opposite sides of the display container 66 to simulate two different types of beverages corresponding to the different concentrates within sources 12 and 13. Preferably the bowl 66 is filled approximately three-quarters of the distance from the bottom to the top. Such partial filling has been found to be most effective in stimulating consumer demand. Thereafter the cover 74 is secured in place to seal the bowl 66 and the ornamental cover 77 is applied.

At the beginning of the business day, one of the switches 71 is actuated to energize the refrigeration assembly and to enable closing of electrical circuits to the whipping motors 46 upon subsequent actuation of the switches 49. Closing the other switch 71 energizes the motors for the jet assemblies 67. The refrigeration assembly is conventionally controlled by thermostatic means to maintain a uniform cooling effect on the water passing through the refrigerator 30 to the mixing blocks 28 and 29. When it is desired to dispense a beverage, a cup 31 is pressed against one of the switch operating levers 48 to activate the associated switch 49 and thus energize the associated whipping motor 46 and the associated pair of solenoid valves 51, 52 or 53, 52. Energizing solenoid valve 52 raises the solenoid valve plunger 81 from its seated position closing port 82, initiating flow of chilled water through its conduit 34 from the refrigerator 30 and into the conduit system 78, 79, 83, and 84 into the whipping chamber 54.

The simultaneous energizing of solenoid 51 or 53 opens a port 82 in the associated concentrate line to enable flow of pressurized concentrate from the pump 16 or 17 and into the mixing chamber 54 via inclined duct 85 of the associated block 28 or 29 in a manner similar in all respects to the above described flow system for the water into the inclined duct 84. Water and concentrate ejecting from the conduits 84 and 85 impinge adjacent to the top of the mixing chamber 54 in a mixing action that also initiates the above mentioned swirl in the general direction of the water flow from duct 84. Simultaneously with the opening of the ports controlled by valves 52 and 51 or 53, the whipper motor 46 for the appropriate mixing block 28 or 29 is energized to whip the mixed beverage conventionally to a frothy beverage that is discharged through outlet 56 and spout 95 into the cup 31.

Of course where whipping is not desired, the whipping blade 59 and motor 46 will either be eliminated or disabled.

In that event, the water and concentrate from the ducts 84 and 85 will mix and flow spirally several times around the circumference of the mixing chamber 54, then fall be gravity to the bottom of the chamber 54 and through the outlet 56 and spout 95 into the container 31.

Figure 7:
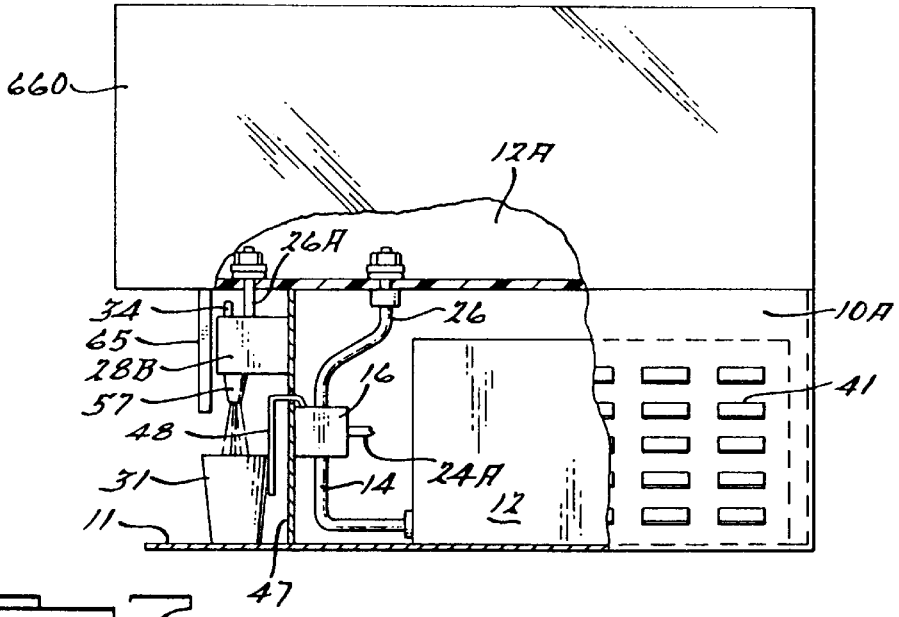
FIG. 7 is a diagrammatic side elevational view, partly in section, of an embodiment of the invention wherein the display bowl is filled with beverage concentrate and wherein a replaceable bag-in-box supply of beverage concentrate is stored in a housing that simulates a housing for a refrigeration unit.

FIG. 7 illustrates a modification wherein the beverage concentrate itself comprises the display fluid. A hollow simulated refrigeration housing 10A contains a bag-in-box supply 12 of concentrate 12A that is caused to flow through conduits 14 and 26 into a sealed transparent storage-display bowl 660 by operation of pump 16. The latter operates as described in regard to FIG. 1 and is secured to panel 47. Power 24A for its operation may be pressurized carbon dioxide gas as described above, or electrical. The housing 10A may be louvered as at 41 to simulate air vents for a cooling unit and the display bowl 660 may be similar in structure and external appearance to bowl 66, except that only a single display bowl 660 for supplying one type of beverage is shown in FIG. 7. Preferably bowl 660 is sealed and completely filled with the concentrate 12A.

A valve block 28B containing proportioning valves 51 and 52 is secured to panel 47 and receives water and beverage concentrate via conduits 34 and 26A respectively under the control of the proportioning valves 52 and 51 respectively, which dispense the water and concentrate in predetermined proportions into block 28B on demand as described above in regard to FIGS. 4 and 5. The upper end of conduit 26A is in fluid communication with the concentrate 12A in display bowl 660. The mixed beverage components are then dispensed through spout 57 into container 31. Of course the conduits 26 and 26A pass through the bottom of bowl 660 at sealed locations. Thus as concentrate 12A flows through conduit 26A into block 28B, it is immediately replaced under pressure via conduit 26 from pump 16.

If the bowl 660 is sterile when it is initially filled with concentrate, the concentrate will resist bacterial contamination for an extended time, often for a year or more by virtue of not being exposed to the diluent or air borne contamination. A very satisfactory sales enhancing display having essentially the appearance of the dispensed beverage is thus achieved.

The FIG. 7 modification is adapted for use where no refrigeration is required and wherein the beverage is preferably dispensed into cracked ice within cup 31. Where refrigeration is desired, the housing 10A may contain a refrigeration unit as in FIG. 1. In that situation, the bag-in-box supply 12 and pump 16 may be provided at any convenient location, as for example below the counter as in FIG. 1.

Figure 8:
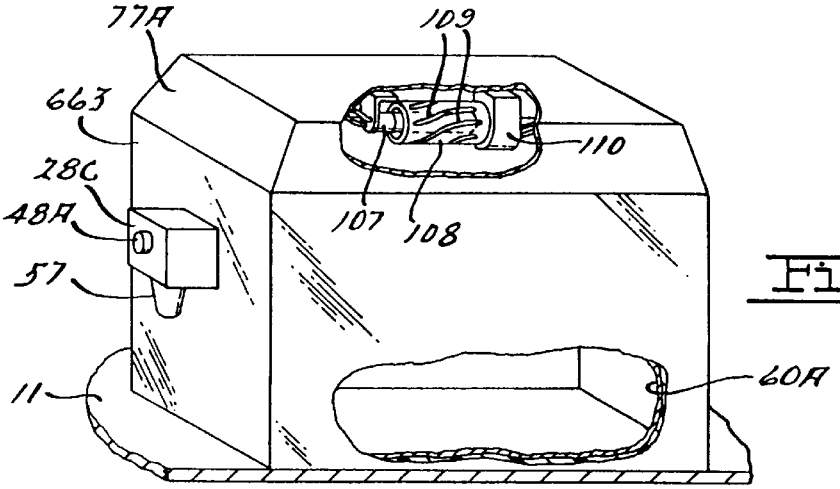
FIG. 8 is a diagrammatic elevational view, partly in section, illustrating a simulation of a transparent storage-display bowl containing a beverage.

FIG. 8 illustrates a modification of the invention wherein a simulation of a transparent display bowl containing a beverage to be dispensed is combined with a post-mix dispenser operative as described above. A hollow transparent display bowl 663, which may be similar in external appearance to the bowl 66, is supported on the counter top 11. Valve block or housing 28C and dispensing faucet 57 are supported on the exterior of the bowl 663. The auxiliary equipment for supplying beverage concentrate and diluent to block 28C may be essentially the same as described in regard to FIG. 1, except that the refrigeration unit is eliminated and block 28C incorporates a push button 48A instead of lever 48 for actuating the proportioning valves 51,52 when beverage dispensing is desired. The sidewalls of the bowl 663 are comparatively thick clear plastic provided with an interior coating 60A which may be a translucent paint or gel coating or a layer of sheet plastic colored to resemble the beverage to be dispensed.

The cover 77A for the bowl 663 is opaque and may resemble the cover 77 externally. Supported within the cover 77A is a tubular electric light bulb 107, which may also be colored to resemble the color of the actual beverage to be dispensed. Extending around the bulb 107 is an opaque tubular shield 108 slotted longitudinally to provide slits 109 for passage of illumination from bulb 107. The shield 108 is supported and rotated by an electric motor 110 suspended from the interior of the cover 77A. The illumination from the bulb 107 passing through the rotating slits 109 strikes and illuminates coating 60A with the color of the beverage to effect the appearance of beverage movement. Preferably the slits 109 extend spirally along the shield 108 to effect a progressive wave motion as the shield rotates. Also the motor 110 may rotate the shield 108 intermittently at variable speeds to effect the appearance of a choppy wave motion.

We claim:

1. An apparatus comprising the combination of a post-mix beverage dispenser having a dispensing outlet for discharging beverage components in predetermined proportions to provide a serving of a dispensed beverage for immediate consumption, and a display simulating, without reliance on a liquid, a transparent display container containing a visible quantity of said beverage displayed therein sufficient to provide multiple servings, said display being sized and positioned relative to said dispensing outlet to create the visual impression that said display is the principal source of said beverage discharged from said dispensing outlet.

2. An apparatus according to claim 1, said display comprising a container having the color of the dispensed beverage.

3. An apparatus according to claim 2, said display further comprising a source of illumination projecting illumination in a manner to effect the appearance of said simulated beverage being in motion.

4. An apparatus according to claim 3, said source of illumination being operative to project said illumination in varying intensity progressively across a surface of said container.

* * * * *

UNITED STATES PATENT AND TRADEMARK OFFICE

CERTIFICATE OF CORRECTION

PATENT NO. : 6,059,145
DATED : May 9, 2000
INVENTOR(S) : Gus Stratton et al.

It is certified that error appears in the above-identified patent and that said Letters Patent is hereby corrected as shown below:

Title page,
Related U.S. Application Data, "and a continuation of application No. 08/406,819" to and including "application No. 07/402,198, Sep. 1, 1989, abandoned" has been cancelled.

Column 1,
Lines 5-12, "which is a Continuation-in-Part of Ser. No. 08/406,819" to and including "Ser. No. 07/402,198, filed Sep. 1, 1989 now abandoned" has been cancelled.

Signed and Sealed this

Twenty-eighth Day of May, 2002

*Attest:*

*Attesting Officer*

JAMES E. ROGAN
*Director of the United States Patent and Trademark Office*